United States Patent [19]

Zalmon et al.

[11] Patent Number: 4,641,802

[45] Date of Patent: Feb. 10, 1987

[54] PROJECTILE STABILIZATION SYSTEM

[75] Inventors: Seev W. Zalmon, Haifa; Shlomo Engel, Rishon Le Zyon; Joseph Eyal, Ramat-Hasharon, all of Israel

[73] Assignee: The State of Israel, Ministry of Defence, Israel Military Industries, Israel

[21] Appl. No.: 638,769

[22] Filed: Aug. 8, 1984

[30] Foreign Application Priority Data

Jun. 4, 1984 [IL] Israel ..... 72000

[51] Int. Cl.[4] ..... F42B 13/32; F42B 15/053

[52] U.S. Cl. ..... 244/3.28

[58] Field of Search ..... 244/3.28, 3.27, 49

[56] References Cited

U.S. PATENT DOCUMENTS 4,209,146 6/1980 Mattson ..... 244/3.27

4,440,360 4/1984 Hallström ..... 244/3.28

FOREIGN PATENT DOCUMENTS 76990 4/1983 European Pat. Off. .

*Primary Examiner*—Deborah L. Kyle

*Assistant Examiner*—Michael J. Carone

*Attorney, Agent, or Firm*—Steinberg & Raskin

[57] ABSTRACT

A stabilization system for a projectile includes both fixed fins which extend outwardly from a core and folding fins. Each fixed fin has a pocket wherein a folding fin is pivotably supported. Each folding fin is in the folded state while the projectile is in the bore of the gun from which the projectile is to be fired and the fin unfolds after exiting the bore of the gun. Once the gun is fired to propel the projectile, the folding fins are retained in the folded state due to a moment which is a function of acceleration setback. Shortly after the projectile exits the bore, when the gas velocity Vg exceeds the projectile velocity Vp a moment, due to a pressure difference in the pocket and outside the pocket, is applied to each folding fin to urge it to its unfolded state.

5 Claims, 6 Drawing Figures

PROJECTILE STABILIZATION SYSTEM

The present invention generally relates to stabilized ammunition and, more particularly, to a fin stabilization system which includes both fixed and folding fins to stabilize a projectile which is propelled from the bore of a gun, mortar or the like.

The use of fins for stabilization of projectiles which are propelled from the bore of a gun, mortar or the like at supersonic speeds is well known. Herebefore the most widely used stabilization systems or arrangements incorporate either fixed fins or folding fins. None of the known arrangements provides optimum performance in that the stabilization which the system provides is achieved at the price of reduced projectile range.

As to the fixed fins arrangement, the fins are arrayed in an array which does not exceed the bore or projectile diameter. Fixed fins provide a simple and efficient means of stabilization, provided that their position far enough behind the center of gravity can be accommodated in the design. Otherwise folding fins with spans exceeding the bore or projectile diameter are required. As to the folding fins, they are of one of two types. In one type the fins turn or unfold from a folded state forward or fore with respect to the projectile. In the other type the fins unfold from a folded state backward or aft.

To maintain fins which are unfolded in the forward state a special unfolding mechanism is required to both unfold them as well as to maintain them in the unfolded state since they are constantly subjected to air pressure during the projectile flight. This air pressure is in the direction which tends to fold the unfolded fin. Thus, it is only the special mechanism that tries to maintain them in the unfolded state. Such fins are also subjected to heavy gas pressure due to the muzzle blast. Therefore they have to be made relatively thick in order to be able to withstand such pressure without twisting or bending. This latter-mentioned requirement results in excessively high drag which reduces the projectile range.

According to the present state of the art, fins which unfold backward, initially tend to remain in the folded state as the projectile exits the bore, and thus no stabilization is provided for the projectile until the fins unfold. The unfolding occurs quite far, on the order of tens of meters, from the muzzle and thus during the travel time of the projectile to such a distance there is only a partial stabilization which greatly affects the subsequent path of the projectile. A need therefore exists for a new fin stabilization system for projectiles propelled from a gun or the like. This need is satisfied by the novel invention which can be summarized as, a fin stabilization system for a projectile which is propellable from the bore of a gun by the pressure of gases produced in the gun, comprising:

a plurality of fixed fins arrayed aft of the projectile from a core outwardly, each fixed fin defining a pocket extending inwardly from a top side of the fixed fin toward the core from which the fin extends;

folding fins accommodatable within the pockets of the fixed fins, each folding fin being pivotably supported in the pocket, whereby when the gun is fired and the projectile accelerates in the gun's bore, a moment is applied to each folding fin to retain it in the pocket and as soon as the projectile exits the bore each folding fin unfolds backwardly as a function of the difference of pressures resulting from the difference between the velocity of the gases exiting out of the bore and the projectile velocity.

As should be apparent from the foregoing and as will be described in detail hereinafter in accordance with the present invention a stabilization system is provided which includes both fixed fins and folding fins. The latter are protected within pockets of the fixed fins and are unfolded therefrom not by a special mechanism but as a result of the phenomena occurring due to the projectile firing. For example, the set-back acceleration, occurring while the projectile is still in the bore, is used to produce a moment on each folding fin to maintain it in its pocket and thus not come in contact with the bore surface. As the projectile leaves the bore the difference in pressure resulting from the difference in the instantaneous velocity of expanding powder gases and the velocity of the projectile provide the necessary moment to unfold the folding fins.

Such unfolding occurs upon the projectile exiting the bore and thus additional stabilization is provided within a view meters of the projectile leaving the gun. Due to the fact that the unfolding fins are protected during the critical time of muzzle exit by being positioned in the pockets of the fixed fins, the folding fins need not be thick. In fact, they are made quite thin and with special aerodynamic features in order to minimize the drag which they cause. Likewise, the fixed fins need not be very thick since they extend only to a relatively short radial distance. Consequently, they can be made relatively light, thereby reducing drag which accounts for increased range with optimized stability.

The novel features of the invention are set forth with particularity in the appended claims. The invention will best be understood from the following description when read in conjunction with the accompanying drawings.

BRIEF DESCRIPTION OF THE DRAWINGS

Attention is now first directed to FIGS. 1 and 2. In FIG. 1 numeral 10 designates one embodiment of the novel stabilization system of the present invention. The system 10 includes a core 11 which is shown connected to a projectile 12 via an adaptor 14. The core is assumed to extend to the rear of the system. Hereafter the terms "forward" or "fore" and "backward" or "aft" are intended to be in relation to the position of the projectile 12 with respect to the system.

Extending upwardly from core 11 are a plurality of arrayed fixed fins designated by 21, 22 and 23. The number of fixed fins may vary from as few as three to ten or more. Each fixed fin, example fin 21, has a recess or pocket 25 which extends inwardly into the fixed fin from its top side 26 toward the core. The pocket is large enough to accommodate a folding fin therein. In FIG. 1 the folding fins are designated by the numeral 30. Each folding fin is in the pocket 25 of the fixed fin with which it is associated, as shown in top view in FIG. 2. The top of the area of the folding fin 30 is designated A (FIG. 4). To facilitate the following description, the term "fin" alone may be used to refer to a folding fin while whenever referring to a fixed fin the entire term plus its adjective "fixed" will be used.

Figure 1:
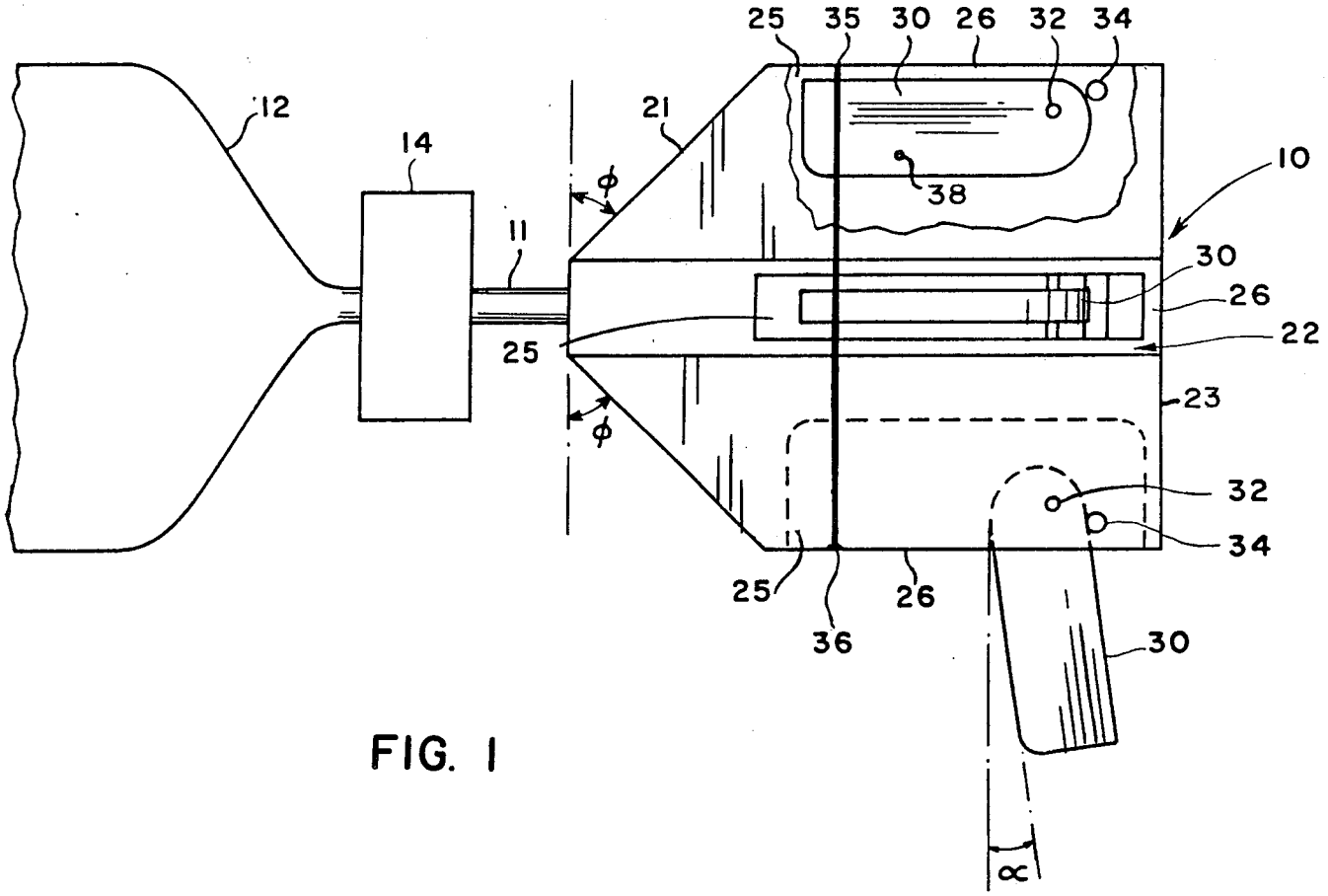
FIG. 1 is a side view useful in explaining the basic principles of the invention.

Each fin 30 is hingedly supported by means of a pivot pin 32 in the pocket of the fixed fin with which it is associated. By means of this pivot pin each fin may pivot between a closed folded position as shown for fin 30 in fixed fin 21 to an unfolded or open position, as shown for fin 30 associated with fixed fin 23. Provided in each pocket is a stop-pin 34 which serves to limit the extent to which a fin 30 can be unfolded from its associated fixed fin, as clearly shown for the unfolded fin 30 in FIG. 1.

As seen therefrom, when a fin 30 is in the closed or folded position it is totally enclosed within the fixed fin with which it is associated, while extending outwardly beyond the top surface (side) 26 of the fixed fin when being in the unfolded state. The stop-pin is located so as to enable the fin to unfold backwardly or aft by an appropriate angular relationship such as the angle $\alpha$ shown in FIG. 1.

In order to load the projectile 12 with the stabilization assembly 10 into a gun the folding fins 30 need be in their closed or folded state. To so maintain them a thread 35 located in appropriate slots 36 on the top sides 26 of the various fixed fins may be wound around them so as to prevent the folding fins from accidentally exiting the pocket in which they are located. As will be pointed out hereafter the thread 35 typically burns off in the bore and thus enables the folding fins to unfold. If desired, instead of thread 35 a shearing pin 38 may be inserted in each folding fin when in the folded position. Such pin is then sheared off by the forces applied to the folding fin 30 to pivot it into its unfolded state.

Figure 3B:
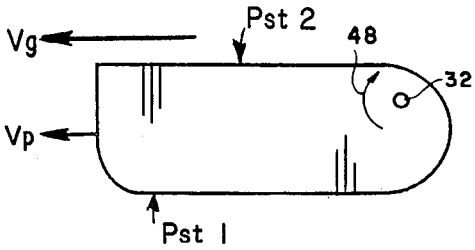
FIGS. 3A and 3B are force diagrams in relation to the folding fin.
Figure 3A:
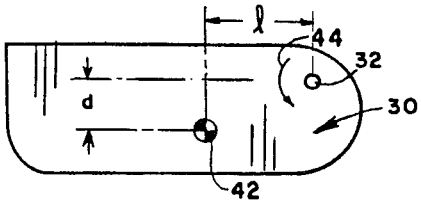

Attention is now directed to FIGS. 3A and 3B which are simple diagrams of a folding fin 30 and forces to which it is subjected. All of these forces are as a result of projectile firing and not from special mechanisms. As the gun is fired to propel the projectile 12 toward a target and as the projectile accelerates, a force F is applied to the fin 30. The force F equals $m \cdot a_{sb}$ where m is the mass of the fin 30 and $a_{sb}$ is the acceleration setback. The fin 30 is designed so that its center of gravity, designated by numeral 42 in FIG. 3A is closer to core 11 or the projectile's longitudinal axis than the pivot pin 32. The distance difference is d. Thus the fin 30 is subjected to a closing moment $M = F \cdot d = m \cdot a_{sb} \cdot d$. This closing moment is represented in FIG. 3A by arrow 44. Such a moment retains all the folding fins 30 in their closed or folded state, thereby preventing them from making contact with the gun's bore. While the projectile is still in the bore the pressure to which each fin 30 is subjected is the gas pressure $P_{st}$. It is uniform all over the fin. Also the gas velocity $V_g$ is approximately equal to the projectile velocity $V_p$.

As the projectile exits the bore a muzzle blast takes place. However, since the folding fins 30 are still in the pockets of the fixed fins, the former are protected from the blast. Within a very short distance from the muzzle, e.g. several meters, an imbalance of forces, acting on the fins 30 takes place, which causes them to unfold. More specifically, the pressure in each pocket 25 is $P_{st1}$. This force acts to unfold the fin out of the pocket. The pressure on the top of the fin acting to keep it folded is $P_{st2}$, where $P_{st2} = P_{st1} - \frac{1}{2}\rho_g (V_g - V_p)^2$.

The term $\rho_g$ is the average density of propellant gases. $\rho_g$ can be approximated by dividing the mass of propellant by the free volume of the gun after the projectile left the muzzle.

Figure 4:
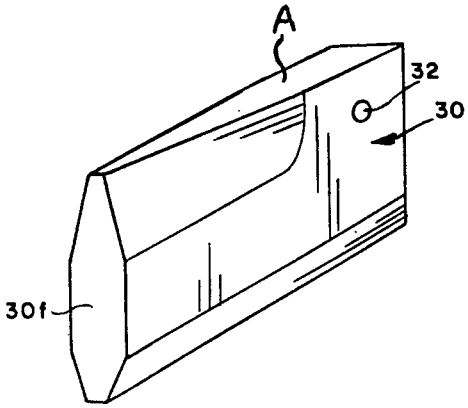
FIGS. 4 and 5 are views of a folding fin actually reduced to practice.

The pressure difference of the fin is $\Delta P = P_{st1} - P_{st2} = \frac{1}{2}\rho_g (V_g - V_p)^2$. Since outside the muzzle the gas velocity $V_g$ is greater than the projectile velocity $V_p$ a moment M is applied to each fin 30, as represented in FIG. 3B by arrow 48. $M = \Delta P \cdot A \cdot l$ (A being the area of the top surface of folding fin 30 as seen in FIG. 4). It is this moment which causes each folding fin 30 to unfold as shown in FIG. 1, for fin 30 of fixed fin 23. The moment 48 is sufficiently great to shear any shearing pin 38, if used, to keep folding fins 30 closed. If, instead of shearing pin 38, thread 35 is used it typically burns off in the bore.

It should be pointed out that when associated with projectiles which spin slowly as they propel toward the target, the stabilization assembly is subjected to a centrifugal force which provides an additional small moment to open or unfold the fins 30.

Figure 5:
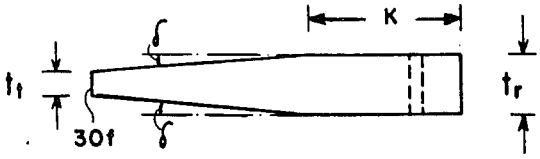

Attention is now directed to FIGS. 4 and 5, in connection with which the shape of the folding fin 30, actually reduced to practice, will be described. FIG. 4 is a perspective view of the fin 30 while FIG. 5 is a top view. As seen in FIG. 4 the folding fin has a double wedge shape as viewed from the fore end 30*f* of the fin. Such shape reduces drag created by the fin. It also provides the projectile with desirable residual spin for increased accuracy. As seen from FIG. 5, the thickness of the aft part of the fin 30 is uniform and designated by $t_r$ over a length k toward the fore end. This part k of the folding fin is always within the pocket. From that point toward the fore end 30*f* the fin tapers down to a thickness $t_f$ where $t_f < t_r$. The fin tapers symmetrically on both sides at an angle $\delta$ to reduce drag.

Figure 2:
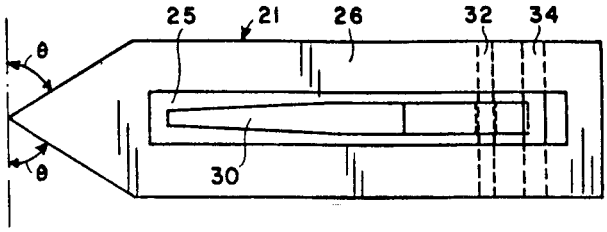
FIG. 2 is a top view of a fixed fin with a folded fin inside its pocket.

As to the shape of each of the fixed fins, the leading edge of the fin as viewed from the side (FIG. 1) is shaped backward at an angle $\phi$, and as viewed from the top (FIG. 2) its front is double bevelled at an angle $\theta$. The aft end of each fixed fin may also be bevelled.

From the foregoing it should thus be clear that in the stabilization system of the present invention both fixed and folding fins are employed. Physical phenomena actually occurring during projectile travel in the bore and upon its exiting the bore are used to maintain the folding fins closed and then unfold them, respectively. The unfolding of the folding fins occurs at an extremely short distance, e.g. several meters from the muzzle. Thus added stabilization is provided for increased accuracy. Until the folding fins unfold the fixed fins provide static stabilization. Since the fin arrangement is not subjected to high loads it can be made lighter and thinner. Thus, drag is small, accounting for increased range. The fixed fins are also shaped to reduce drag. As to the folding fins they are also shaped to reduce drag and at the same time provide sufficient strength to withstand bending moments.

Although particular embodiments of the invention have been described and illustrated herein, it is recognized that modifications and variations may readily occur to those skilled in the art and consequently, it is intended that the claims be interpreted to cover such modifications and equivalents.

We claim:

1. A system for stabilizing a projectile which is propellable by gas pressure out of a bore of a firing device toward a target, the system comprising:

a plurality of fixed fins arranged aft of the projectile and extending outwardly from a core, each fixed fin defining a pocket which extends inwardly from a top side of the fixed fin; and a plurality of folding fins each pivotably accommodatable in the pocket of a fixed fin, with each folding fin being totally within a pocket when in the folded state and being pivotable to assume an unfolded state where a substantial portion of the folding fin is out of said pocket when said projectile and system exit the device's bore, each of said folding fins being adapted to unfold in a sense opposed to the flight direction of said projectile, wherein each of the folding fin is adapted to unfold as a function of a moment applied to the folding fin, the moment M' being definable as $M'=\Delta p \cdot A \cdot l$ wherein $\Delta p=\frac{1}{2}\rho_g (V_g-V_p)^2$, $\rho_g$ is the average density of the propellant gas, $V_g$ is the gas velocity after exiting the bore, $V_p$ is the projectile velocity after exiting the bore, A is the area of the top surface of the folding fin and 1 is the distance between a pivot pin about which the folding fin pivots and the fin's center of gravity.

2. A system for stabilizing a projectile which is propellable by gas pressure out of a bore of a firing device toward a target, the system comprising:

a plurality of fixed fins arranged aft of the projectile and extending outwardly from a core, each fixed fin defining a pocket which extends inwardly from a top side of the fixed fin; and a plurality of folding fins each pivotably accommodatable in the pocket of a fixed fin, with each folding fin being totally within a pocket when in the folded state and being pivotable to assume an unfolded state where a substantial portion of the folding fin is out of said pocket when said projectile and system exit the device's bore, each of said folding fins being adapted to unfold in a sense opposed to the flight direction of said projectile, wherein a center of gravity of each folding fin is located with respect to a pivoting axis, so that as a result of acceleration setback a moment is applied to the folding fin to pivot it in a direction to retain it within the pocket, and wherein each folding fin is adapted to unfold as a function of a moment applied to the folding fin, the moment M' being definable as $M'=\Delta p \cdot A \cdot l$ where $\Delta p=\frac{1}{2}\rho_g (V_g-V_p)^2$, wherein $\rho_g$ is the average density of the propellant gas, $V_g$ is the gas velocity upon exiting the bore, $V_p$ is the projectile velocity upon exiting the bore, A is the area of the top surface of the folding fin and 1 is the distance between a pivot point about which the fin pivots and its center of gravity.

3. A system for stabilizing a projectile which is propellable by gas pressure out of a bore of a firing device toward a target, the system comprising:

a plurality of fixed fins arranged aft of the projectile and extending outwardly from a core, each fixed fin defining a pocket which extends inwardly from a top side of the fixed fin;

a plurality of folding fins each pivotably mounted in the pocket of a fixed fin about a pivot axis, with each folding fin being totally within a pocket when in the folded state and being pivotable to assume an unfolded state where a substantial portion of the folding fin is out of said pocket when said projectile and system exit the device's bore; and wherein each of said folding fins has a center of gravity located forwardly of said pivot axis and spaced therefrom by a distance l and a top surface having an area A, said distance l and area A having values such that a moment M' acting on said folding fin after the projectile exits the bore and defined by $M'=\Delta p \cdot A \cdot l$, wherein $\Delta p=\frac{1}{2}\rho_g (V_g-V_p)^2$, $\rho_g$ is the average density of the propellant gas, $V_g$ is the gas velocity after exiting the bore, and $V_p$ is the projectile velocity after exiting the bore, is sufficient to pivot said folding fin out of said pocket.

4. A system for stabilizing a projectile which is propellable by gas pressure out of a bore of a firing device toward a target, the system comprising:

a plurality of fixed fins arranged aft of the projectile and extending outwardly from a core, each fixed fin defining a pocket which extends inwardly from a topside of the fixed fin; and a plurality of folding fins each pivotably accommodatable in the pocket of a fixed fin, with each folding fin being totally within a pocket when in the folded state and being pivotable to assume an unfolded state where a substantial portion of the folding fin is out of said pocket when said projectile and system exit the device's bore, each of said folding fins being adapted to unfold in a sense opposed to the flight direction of said projectile, wherein each folding fin unfolds as a function of a moment M' definable as $M'=\Delta p \cdot A \cdot l$ where $\Delta p=\frac{1}{2}\rho_g (V_g-V_p)^2$, where $\rho_g$ is the average density of the propellant gas, $V_g$ is the gas velocity after exiting the bore, $V_p$ is the projectile velocity upon exiting the bore, A is the area of the top surface of the folding fin and l is the distance between a pivot point about which the fin pivots and its center of gravity.

5. The system as recited in claim 4 wherein the center of gravity of each folding fin is located with respect to the pivoting axis, so that as a result of acceleration setback, a moment is applied to the folding fin to pivot it in a direction to retain it within the pocket.

* * * * *